United States Patent [19]

Kubacki et al.

[11] Patent Number: 4,592,668

[45] Date of Patent: Jun. 3, 1986

[54] METHOD FOR STAMPING INDICIA ON MATERIALS

[75] Inventors: Edward F. Kubacki, Marengo; Edward C. Jacobs, Wauconda; John M. Masciale; James R. Monroe, both of Palatine, all of Ill.

[73] Assignee: American Can Co., Greenwich, Conn.

[21] Appl. No.: 616,238

[22] Filed: Jul. 20, 1984

Related U.S. Application Data

[62] Division of Ser. No. 430,761, Sep. 30, 1982, Pat. No. 4,476,781.

[51] Int. Cl.[4] ..... B41F 17/00

[52] U.S. Cl. ..... 400/127; 101/4; 400/166; 400/364

[58] Field of Search ..... 101/3 R, 4, 18, 42, 101/43, 45; 400/132, 134, 166, 157.3, 364, 127, 128, 134.5, 134.6

[56] References Cited

U.S. PATENT DOCUMENTS

| | | | |
|---|---|---|---|
| 1,200,558 | 10/1916 | Wilbur et al. | 400/364 |
| 2,142,009 | 12/1938 | Siebert | 400/132 |
| 2,348,566 | 5/1944 | Papazian | 101/3 R |
| 3,174,426 | 3/1965 | Boekeloo et al. | 101/42 |
| 4,262,592 | 4/1981 | Araki | 400/166 X |
| 4,287,824 | 9/1981 | Boyle | 101/45 |
| 4,302,117 | 11/1981 | Tomita | 400/166 |
| 4,326,814 | 4/1982 | Schaffer et al. | 400/125.1 |
| 4,431,320 | 2/1984 | Alff et al. | 400/134 X |
| 4,476,781 | 10/1984 | Kubacki et al. | 101/3 R |

OTHER PUBLICATIONS

Anderson, et al., "Typewriter Print Impression Control", IBM Technical Disclosure Bulletin, vol. 24, No. 8, Jan. 1982, pp. 4316, 4317.

*Primary Examiner*—Clifford D. Crowder

*Attorney, Agent, or Firm*—Paul R. Audet; Daniel M. Rosen; Leonard Cooper

[57] ABSTRACT

In a marking system for stamping materials such as aluminum strip, a pulse of determined energy is supplied to a solenoid, to impart a determined kinetic energy to a die. The die is guided to dissipate substantially all of this kinetic energy in the deformation of the material being stamped. The pulse of energy applied to the solenoid may be controlled by a programmable computer, programmed to control the duration of time that a current is applied to the solenoid. The computer may control a plurality of such solenoids, controlling the times and relative numbers of operation of each of the solenoids.

3 Claims, 11 Drawing Figures

FIRM BOTTLER GAME
017 "ALPHABET"

END COUNT = 1489904

P = 44
K = 421
Y = 1491
X = 2980
Q = 5957
25c = 29773

GAME RESETS 2
POWER FAILS 2

VERSION 006, 009

METHOD FOR STAMPING INDICIA ON MATERIALS

This is a division of application Ser. No. 430,761 filed Sept. 30, 1982, now U.S. Pat. No. 4,476,781.

BACKGROUND OF THE DISCLOSURE

This invention relates to the stamping of indicia in and on materials, and is particularly directed to improvements in an apparatus for stamping indicia in sheet metals, such as aluminum, wherein the stamping is substantially independent of operating conditions and is readily adaptable to computer control. While the invention is specifically concerned with the marking of tabs of aluminum cans for promotional purposes, it will be evident that the invention is adaptable to other uses, and may also be employed for marking of other materials, such as plastics or the like.

In the marketing of products, the manufacturers of the products frequently desire to create an incentive for the consumer to purchase the product, for example by awarding the customer with free gifts or free products upon the purchase of one of the products having a determined marking thereon. In such incentive programs it is of course necessary for the manufacturer to be able to completely control the number of products that are marked with insignia indicating an award, both from the standpoint of insuring that an excessive number of products or gifts are not given away and that the purchasing public does not question the integrity of the manufacture.

SUMMARY OF THE INVENTION

The present invention is specifically directed to the marking of metal products by a stamping technique. The stamping of the metal products must of course be done in such a manner that the marking will not be visible to the purchaser until after the purchase of the specific product, for example, upon some manipulation of the product by the user. The following disclosure is specifically concerned with such marking of metal cans, such as aluminum beverage cans, wherein the cans may be opened by pulling out can end closure tabs. Such tabs are generally formed from a continuous strip of metal, such as an aluminum strip, and may be stamped on the side thereof that later forms the underside of the tab. Consequently, the purchaser cannot be aware of the specific indicia on a can of beverage that has been purchased until the tab has been lifted to open the can.

In the manufacture of cans of this type, the tabs are separately formed from strip aluminum. The marking of the tabs is effected by stamping the indicia in the strip at predetermined locations such that they are properly aligned with the tabs that are later formed therein by punching and bending operations. In the conventional technique for stamping the aluminum strip, a strip is moved through a stamping assembly, and momentarily stopped for each stamping operation. The stamping dies must be moved very precisely, for example being controlled in the movement toward the aluminum strip by stops or the like, i.e. the dies are dimension controlled to come within a fixed distance from the stationary die plate. While precisely mechanically controlled stamping of this type produces the satisfactory markings under ideal conditions, the stamping or pressing of the markings by this technique is subject to variation in the quality of markings, due, for example, to variation of the dimensions of the press.

Presses of this type are usually made of steel, such that the components thereof expand upon heating and contract upon cooling. As a consequence, when initially starting the press, it is necessary to run the equipment for a period of time until it heats up to such a temperature that the press components have the desired dimensions for producing good stamps. This of course results in undesirable initial delays in the operation of the equipment, and wastage of the material passing through the press during the warming-up procedure.

In addition, presses of the above type are subject to variation and quality as a function of the thickness of the material being marked by scoring. When the die is stopped in its movement toward the material, a precisely fixed gap remains between the die and the facing die plate. Consequently, if the material being stamped has a reduced thickness, the embossed stamp will be shallower, while, if the material being stamped is thicker, the embossed stamp will be deeper. In order to compensate for such variations of material, it is necessary to adjust the stops, for example, by shimming. Since such shimming may require shut down and cooling of the press, it is difficult to accurately adjust such equipment. It has been found necessary when employing pressing machines of this type for stamping indicia on the tabs, that adjustments must be frequently made in the equipment, in order to insure satisfactory stamping.

The requirement for changing the stamping on a determined number of tabs, in order that several types of indicia may be stamped in the various tabs, in accordance with a determined relationship, introduces additional problems when employing conventional stamping equipment that presses dies into the material. In order to insure the desired precise stamping conditions, it is conventional to provide only a single stamping press for each row of indicia to be stamped in the metal strip. The requirement for changing indicia thus requires the manual changing and adjusting of the dies for stamping the different indicia. Since it is desired that the distinguishing indicia corresponding to different awards be distributed throughout the entire run of tabs to be produced, so that the "winning" tabs are not all in one sequential block, it is necessary to very frequently change the dies of the press. This of course greatly increases the time and effort necessary for producing the tabs. Systems of this type are thus not "programmable".

The present invention is therefore directed to a method and apparatus for marking materials with a die, that overcomes the above disadvantage of known stamping systems employing pressing dies. The invention is further directed to the provision of a marking system particularly useful in the marking of metallic strips, such as aluminum strips, wherein the quality of stamping is substantially independent of temperature of the equipment, and is substantially independent of the thickness of the metals to be stamped, and wherein the selective stamping of different indicia in a common strip, according to a predetermined relationship, is readily effected without any requirement for stopping a run.

Briefly stated, in accordance with the one embodiment of the invention, the dies for stamping the material are not pressed into the material, but are "projected" into the material with a precisely predetermined energy. For this purpose, the dies are preferably moved by the armature of a solenoid, the solenoid having been energized by a precisely controlled energizing pulse, i.e., having a well defined energy. The dies are initially spaced from the material, so that the energy of the solenoid is transferred to the armatures and dies as kinetic energy, preferably developing a high velocity in a very short distance. As a consequence, the armature of the solenoid and the die controlled thereby may be moved toward the material to be stamped with a predetermined energy, the die thereby being in a sense, "ballistically" projected at the material. Since the projection of the die is not controlled by any stops, the die stamps the material to a depth that is independent of the temperature of the equipment, and that is independent of the thickness of the material to be stamped.

In particular, the use of the dies in the above manner enables the dies to be readily controlled by a programmable computer, whereby the control of the timing and duration of the pulses for energizing the solenoid enable the automatic stamping of the material.

In addition, since no stops are required for the dies, a precise adjustment of mechanical devices is not required. The stamping system may economically include a plurality of stamping stations arranged, for example, in the direction of the movement of the strip or the material to be stamped. By providing for different indicia to be marked at the different stations, the computer may be readily controlled to stamp the different indicia in any desired numerical proportions, with the different indicia being distributed throughout the entire run of stamping. Adjustment of the stamping characteristics by this arrangement does not require stopping of the run, since the programming of the computer automatically accounts for the movement of the strip to the proper position with respect to the different dies.

While the invention is specifically directed to the stamping of indicia, such as letters, or numbers on the tabs of aluminum ends attached to cans, for promotional schemes, the invention is also satisfactory for marking other strip metals, such as steel, tin plate, etc., as well as plastic materials. The impact stamping system of the invention may be employed without programming control means, since it provides many advantages, such as reduction in condition dependency and adjustment, as compared with conventional stamping devices. The invention is of course especially useful for stamping operations requiring occasional or frequent change of the dies, in addition to the above promotional systems, for example, in the date stamping or sequence stamping of cans, containers, etc.

In order that the invention will be more clearly understood, it will now be disclosed in greater detail with reference to the accompanying drawings, wherein;

DETAILED DESCRIPTION OF THE DRAWINGS

Figure 1:
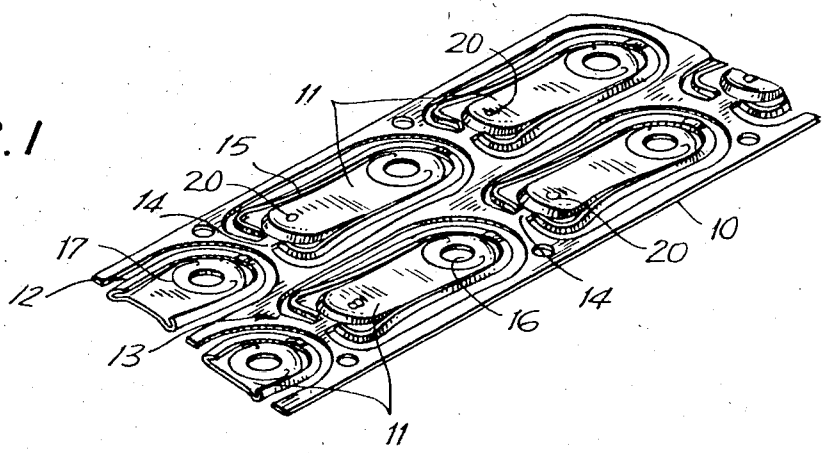
FIG. 1 is a perspective view of a portion of a stamped cut and bent progression or strip of a material such as aluminum, adaptable for the tabs of aluminum cans.

Referring now to FIG. 1, therein is illustrated the underside of a strip 10 of aluminum, having a progression of a plurality of tabs 11. The tabs 11 are aligned in two rows 12 and 13 extending lengthwise of the strip. Each tab 11 becomes severed from the strip except at one break-off bridge 14, the edges 15 of the remainder of the tab being rolled or bent back for strength. Each tab further has an aperture 16 to enable its affixing to the end of a can as well as a sheared line 17 partially encircling the aperture 16 to enable the user to easily lift the tab. On the underside of each tab is a scratch embossed indicia 20, the indicia having been embossed in the strip prior to cutting and bending or rolling the tab. The strip 10 formed as illustrated in FIG. 1, may be employed in a conventional manner in the fabrication of tabs for can ends.

Figure 2:
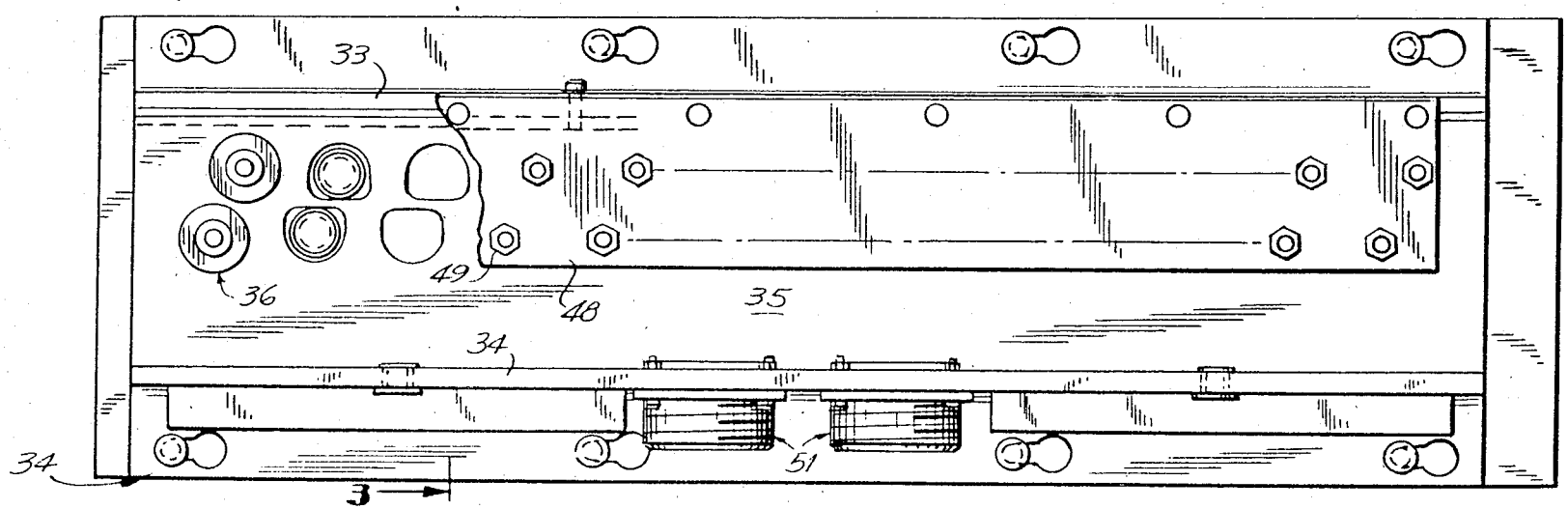
FIG. 2 is a top view of a partial cross-section of one embodiment of a marking system in accordance with the invention.
Figure 3:
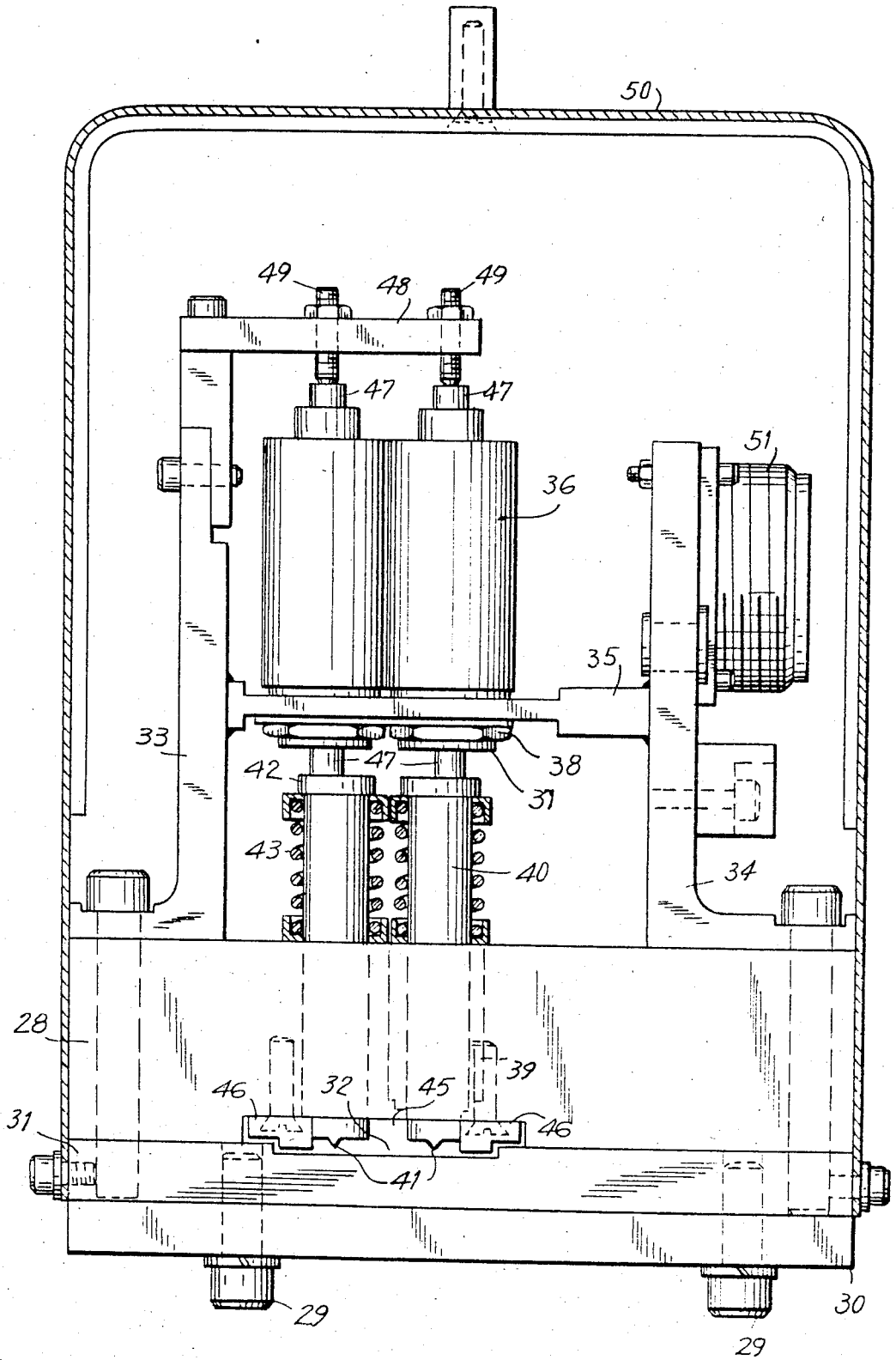
FIG. 3 is a transverse cross-sectional view of the marking system of FIG. 2 taken along the lines 3—3 of FIG. 2.
Figure 4:
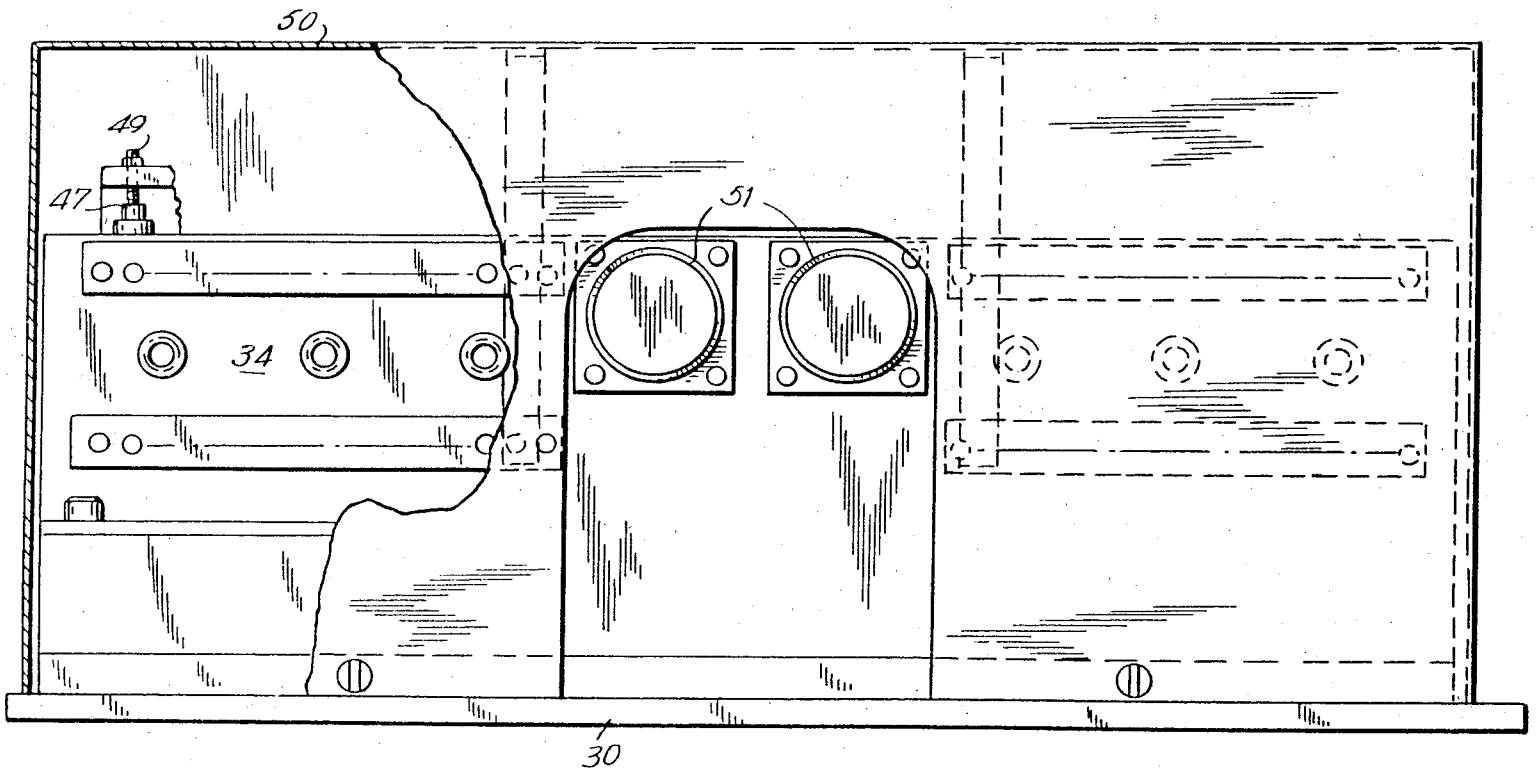
FIG. 4 is a partially cut away side view of the marking system of FIG. 2.

FIGS. 2–4 illustrate one embodiment of a marking system in accordance with the invention for marking strips of the type illustrated in FIG. 1. As illustrated in FIGS. 3 and 4, a base plate 30 is mounted in a fixed horizontal position by any conventional means. The lower die plate 31 is releasably affixed to the top of the plate 30, for example, by bolts 29 extending throug holes in the bottom of the base 30 and threaded into threaded holes in the lower die plate 31. The lower die plate 31 has a recess 32 extending along its upper surface. This recess 32 has a width to permit the aluminum strip 10 to be processed to be fed therethrough. A block 28 is mounted on top of the die plate 31, atop the block 28 are carried a pair of elongated supports 33 and 34 extending upwardly along opposite sides thereof and parallel to the recess 32. A horizontal support plate 35 extends between the vertical support 33 and 34, and plate 35 is spaced from the top of the block 28.

Two rows of solenoids 36 are mounted through the support plate 35, the axes of the two rows of solenoids being aligned with determined positions in the recess 32. The solenoids 36, which will be described in greater detail in the following paragraphs, have threaded mounting bushings 37 in their lower ends extending through suitable holes in the mounting plate 35, the solenoids 36 being firmly held on the plate 35 by nuts 38. In the illustrated embodiment of the invention, in top plan view FIG. 2, each row of solenoids includes 13 solenoids. This number was employed for a specific embodiment of the invention, and it is apparent that any desired number of such solenoids may be selected for any particular application. As illustrated more clearly in FIGS. 2 and 3, the solenoids of the two rows are somewhat staggered thereby permitting the planes of the axes of the two rows to be closer together. That orientation enables use of larger solenoids than would be possible by merely placing the solenoids side by side.

A bore is provided in the block 28 below each solenoid, for receiving a bearing 39 for guiding a die 40. The dies 40 which are preferrably cylindrical, have stamping indicia 41 on their lower ends, these lower ends extending into the recess 32. The upper ends of the dies 40 extend above the block 28, and have enlarged ends 42. Each die is resiliently biased upwardly by a light helical spring 43 encircling the upper end of the respective dies and extending from the under surface of the enlarged head 42 downwardly to the top of the block 28 and can be keyed to prevent rotation.

In order to more firmly guide the upper surface of the strip to be stamped, the bottom of the block 28 may have a recess 45 extending there along above the lower die recess 32, the recess 45 being somewhat wider than the recess 32 to permit assembly of elongated upper guide 46 to extend a sufficient distance into the edges of the recess 32 to loosely guide the top of the aluminum strip.

Armatures 47 extend downwardly from the solenoids 36 to abut the tops of the dies 40. The solenoids 36 are arranged to force their armatures 47 downwardly, and hence force the dies 40 downwardly, upon energization. A horizontal support bracket 48 is affixed to the top of the vertical support 33, the support bracket 48 having suitable further apertures for receiving adjusting screws 49, the screws 49 extending downwardly to adjustably abut the tops of the armatures 47. The adjusting screws 49 hence fix the upper position of the dies 40 under the resilient force of the spring 43. In practice it has been found desirable to adjust these screws 49 so that the bottom of the indicia 41 of the dies is from 0.01 to 0.2, and preferably 0.06 to 0.09 inches above the upper surface of the material to be stamped. If there is no spacing, no kinetic energy will be stored in the armature 47, and there will be no impression in the material. It has been found, however, that this distance is not especially critical, as long as it is large enough to enable the dies to achieve maximum velocity upon energization of the respective solenoid.

As further evident in FIG. 3, the axes of the solenoids 36 and the armatures 47 extending therethrough, may be offset from the axes of the respective dies, thereby permitting an even closer alignment of the planes of the two rows of dies, in order, again, to enable the use of the larger size solenoids.

The assembly of FIGS. 2–4 may be provided with a suitable cover 50 affixed to the base or lower die by any conventional means, and the vertical support bracket 34 may carry a conventional feedthrough 51 for carrying the leads of the solenoids.

In the stamping apparatus of FIGS. 2–4 as discussed above, the aluminum strip to be stamped is slid from one end of the device to the other through the recess 32 in the lower die. The strip hence becomes aligned with the dies 40. The dies 40 may carry different indicia, thereby enabling, in the apparatus of FIGS. 2–4 the possibility of stamping the strip with 13 different marks in each of the two rows. The control apparatus, which will be disclosed in greater detail in the following paragraphs, maintains data concerning the position of the strip at any instance, for example, by suitable sensors in a feed roll drive, so that the different solenoids may be selectively energized at such times that the portion of the strip to be stamped with a particular die is positioned thereunder. This is effected by the program control of the computer of the system.

Figure 5:
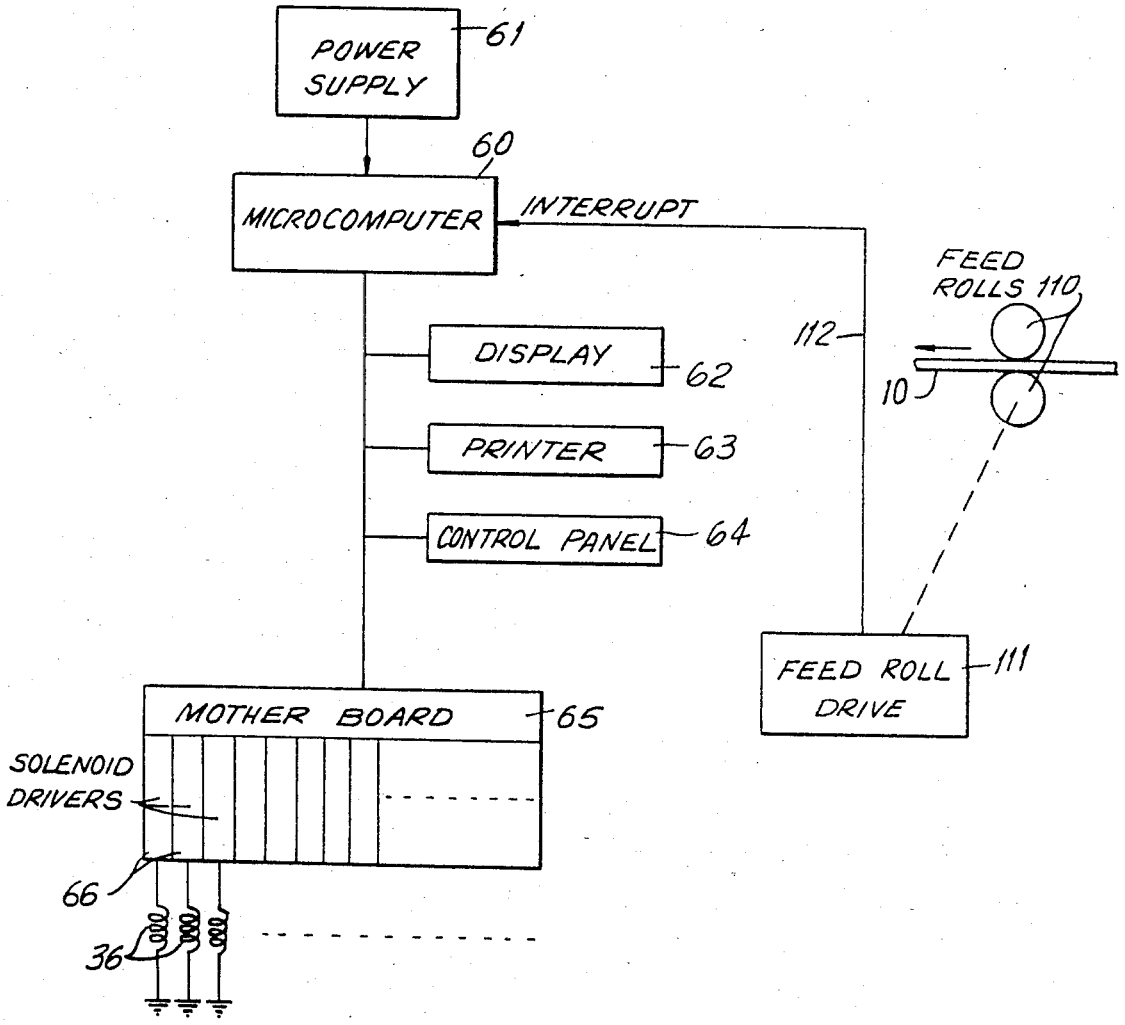
FIG. 5 is a simplified block diagram of the electrical control system of the invention.

In the control system of the invention as illustrated generally in the block diagram of FIG. 5, a microcomputer 60 of conventional design is supplied by a power supply 61. The microcomputer may be, for example, a standard 8024 board manufactured by Intel employing a type 8085 microprocessor. The microcomputer 60 incorporates the conventional program and temporary memory therein. A conventional display 62 and printer 63 may be coupled to the output of the microcomputer, as well as a control panel 64 to be discussed in greater detail in the following paragraphs. In addition, a mother board 65 is provided having an input/output port for each solenoid to be controlled, the mother board receiving the solenoid driver boards 66. A separate solenoid 36 is connected to be driven by each of the drivers 66. As a consequence, it is apparent that the microcomputer may be programmed to selectively control the energization of each of the solenoids 36.

Figure 6:
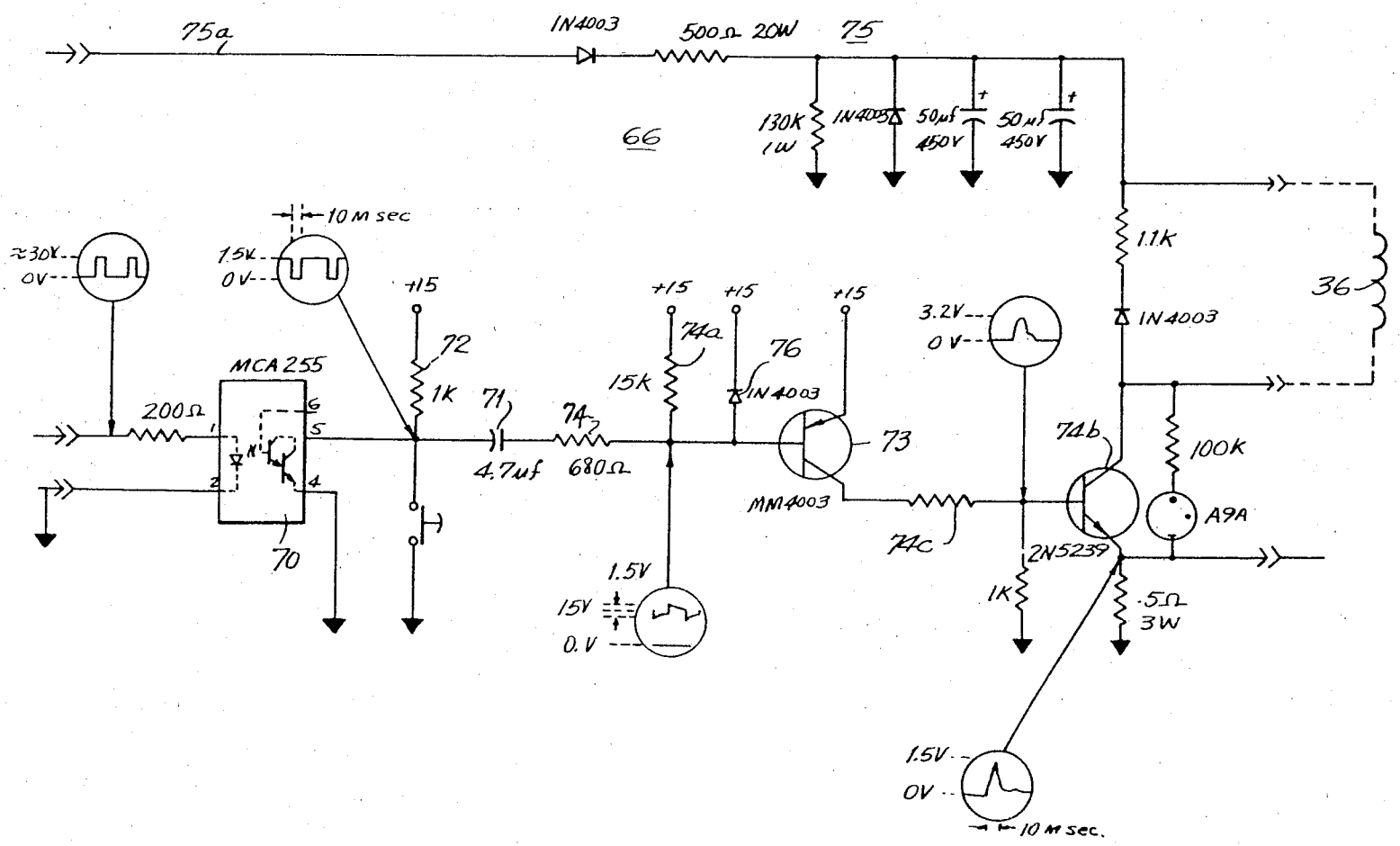
FIG. 6 is a circuit diagram of a solenoid driver for the system of FIG. 5.

The manner for controlling a solenoid in accordance with the concept of the invention is more clearly shown in FIG. 6, which illustrates a circuit diagram of one embodiment of one of the drivers 66 of FIG. 5. While each of the slots of the mother board has interconnections for only 8 data lines, the microcomputer board as above discussed has a plurality of output ports such that four ports may be separately addressed, thereby permitting the separate energization of the eight data bits of each input/output port, to enable the separate addressing of 32 bits. Each of the solenoid driver boards 66 inserted in the mother board is connected to be energized by only one of the 8 bits addressable in the respective slot, so that for each of the 8 slots of each port the respective 8 driver boards are coupled to separately be energized by the 8 data bits of that port.

Referring now to FIG. 6, the input of each board is comprised of an opto-coupler 70, such as a type MCA255, one of the input leads of the opto-coupler 70 being coupled to the system ground in the mother board slot and the other input lead being connected to the respective data bit. Accordingly, the microcomputer may be programmed by conventional timing programs to apply a pulse of determined width to the solenoid driver 66.

The opto-coupler 70 is poled to provide a negative going output pulse, this pulse being applied to one electrode of the capacitor 71. This electrode of the capacitor 71 is also returned to a positive supply source of, for example, 15 volts, by way of resistor 72. The other electrode of the capacitor 71 is coupled to the base of transistor 73 by way of series resistor 74, the base also being coupled to the positive supply by a resistor **74*a* and a diode 76. The collector of the transistor 73 is coupled to the base of a power transistor 74*b* through a resistor 74*c* to limit current. The collector of the power transistor 74*b* is coupled through the respective solenoid 36 to a positive supply. In a preferred embodiment of the invention, in order to render the operation of each of the solenoids 36 independent of each other, each driver 66 is provided with a separate rectification circuit 75 coupled to a terminal 75*a* to which an AC voltage may be applied, for example, the available 110 volt AC supply source. The rectifier circuit 75** may include a conventional half wave rectifier circuit as illustrated.

The microcomputer program determines the duration of the pulses applied to the opto-coupler 70 of each solenoid driver circuit 66. This timed pulse grounds the one terminal of the capacitor 71. Since both electrodes of the capacitor 71 are normally returned to the positive supply, the capacitor 71 normally has no charge. Accordingly, the pulse applied to the capacitor 71 applies a charge thereto as a function of the width of the input pulse. As an example, the input pulses may have widths of about 10 milliseconds. The resultant voltage drop across resistors 74 and 74*a* and the resulting current flow through resistor 74 cause the transistor 73 to conduct. Upon termination of the pulse, the capacitor 71 discharges more rapidly by way of the diode 76 so that the period of conduction of the transistor 74*b* is substantially equal to the duration of the timing pulse. The resultant pulse output of the transistor 73 hence causes the power transistor 74*b* to conduct for a determined time period, so that a determined energy from the capacitors of the rectification circuit 75 can be stored in the field of the respective solenoid 36. The determined energy thereby stored in the solenoid 36 effects the movement of the armature with a determined energy to stamp the metal strip. The energy released to the armature may hence be very precisely controlled by controlling the duration of the pulse applied to the driver circuit 66, for example, by program control in the microcomputer.

In one embodiment of the invention, the solenoid 36 was a two inch long type T-8×16 24 volt Guardian solenoid. Intermittent operation of such solenoids 36 at 10% duty cycle is indicated by the manufacture to permit approximately 600% increase in the power dissipation, as compared with 100% duty cycle. In the above discussed arrangement in accordance with the invention, however, the duty cycle of the solenoids 36 is less than 2%, preferably about 1 to 1½%, and it has been found that the power dissipation of the solenoids 36 may thus be increased at least 50% over the 10% duty cycle figure, for example from 10 to 20 times the continuous rating, without causing any excessive heating in the solenoids 36. This increase in power dissipation enables the use of solenoids 36 of a size that they may be assembled in a sufficiently small space to permit a practical marking system. As above noted, the additional expedient of staggering rows of solenoids 36, and off-setting the guides from the axes of the solenoids 36 further minimizes the size of the equipment.

Since the die 40 is projected toward the material to be stamped with a determined energy, it is apparent that the depth to which the raised portion 41 of the die 40 enters the material is dependent upon the total area of the raised portion 41 of the die 40. Accordingly, in order to compensate for different total line lengths of the indicia 41 of different dies 40, it is apparent that the program may be adapted to provide different width timing pulses for the different indicia 41, so that all of the impressions will have substantially the same depths. Alternatively, the program of the microcomputer may be simplified to provide the same width pulse for energization of each solenoid fired, with the indicia 41 on each die 40 being specifically designed to have substantially the same total length. In this event any changes may be made in the impressions of each die 40 by controlling a single timing cycle common for all the dies 40, or by controlling other common parameters such as the voltage of the supply of current for the solenoids 36.

Figure 7:
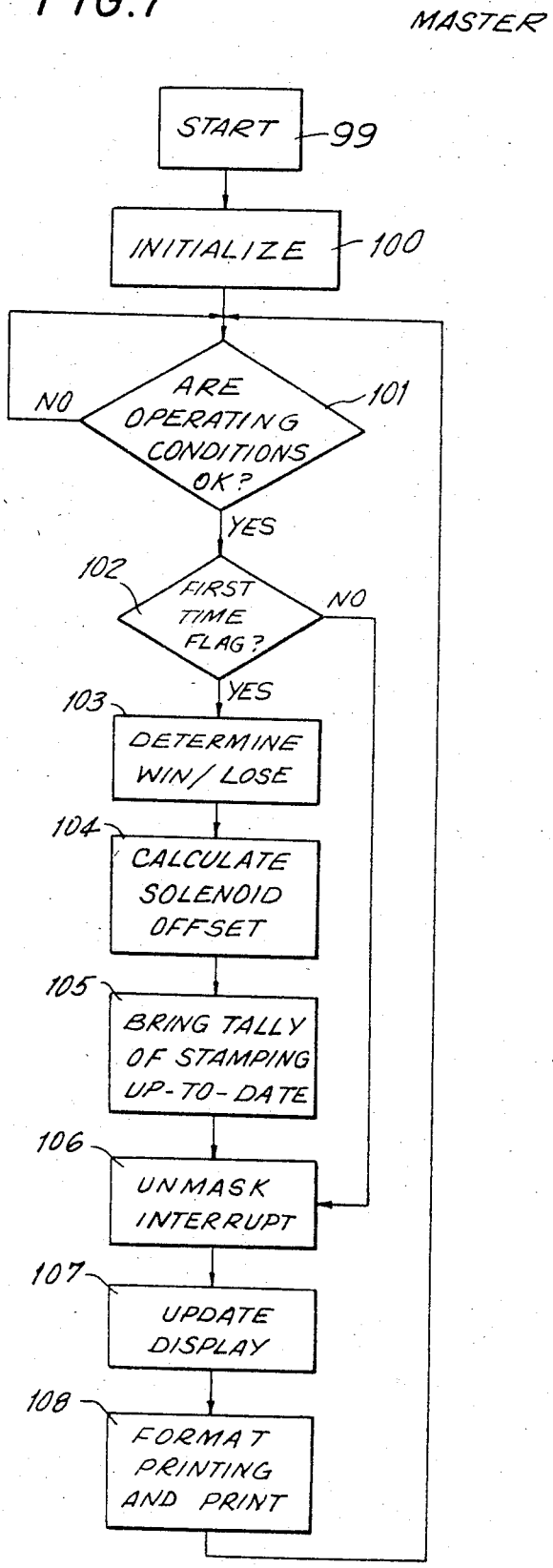
FIG. 7 is a flow diagram of the background program of a marking system in accordance with the invention.

FIG. 7 is a simplified flow diagram for the background program that may be employed in the marking system of the invention. Following starting of the system in block 99 and initialization in block 100, tests are made in block 101 to determine if the operating conditions are satisfactory. These tests may include, for example, determination of proper interconnections between the elements, and the determination if the control for the system has been set to operating conditions. In addition, the program may also determine if other than operating conditions are desired, as set in the control unit, for example, if a printout is desired or a diagnostic switch is set for determination for various conditions in the system. This is of course not inclusive of all of the tests that may be made at this point of the program. Upon determination of proper operating conditions, a test is made in block 102 to determine if a flag has been set indicating that this pass through the program is the first pass, in which case it will be necessary to set various conditions. For example, it will necessary to set a series of counters in block 103 that control the odds on the stamping "winning" or "losing" indicia as well as the amount or value of any "winning" stamp. A subroutine for this purpose will be disclosed later with respect to FIG. 8.

In the first time of operation, before any stamping can be effected, it is also necessary to calculate the solenoid offset, in block 104. Since, in the illustrated embodiment of the invention, there are 13 solenoids in each row, it will be apparent that each location to be stamped on the strip of metal is sequentially aligned with each of the dies in the given row. It is consequently necessary to calculate the time at which any given solenoid is to be energized, in this sequence of positioning, in order to insure that only a single stamp is made at each location and also that a stamp is in fact made at each location. This subroutine will be discussed further with reference to FIG. 9.

In addition, in block 105 a tally is made of all stamping that has occurred to date by the equipment, so that an accurate accounting may be made of the number of markings made of each of the solenoids, thereby to enable determination of the correct operation of the equipment and to insure that the desired ratio has been provided between the various stampings.

Figures 10, 11:
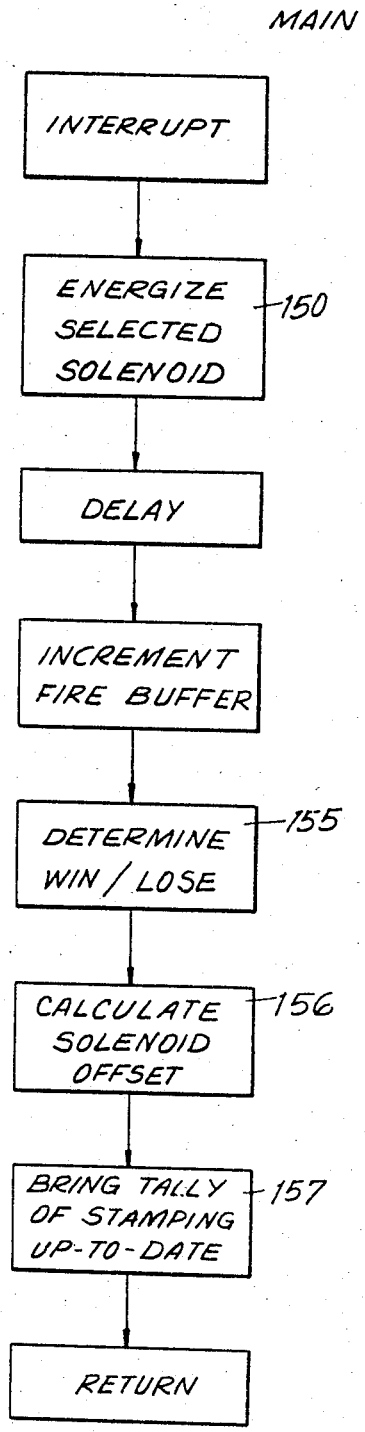
FIG. 10 is a flow diagram of the subroutine for energizing the solenoids.
FIG. 11 is an illustration of a sample print-out of the system in accordance with the invention.

Upon accounting of the set stamping, in block 106 an interrupt of the microcomputer is unmasked. It will be recalled that the feed for the material to be stamped is intermittent, so that each location of the strip to be stamped is stopped momentarily in alignment with each of the marking dies 40. For example referring again to FIG. 5, the feed rolls 110 for advancing the strip 10 are driven by a feed roll drive 111 that drives the feed rolls intermittently, and emits an interrupt signal on the interrupt line 112 of the microcomputer at each stop. In block 106, this interrupt line is unmasked so that the occurrence of the interrupt signal will cause a jump to the main program as illustrated in FIG. 10. If the setting of the winning and losing counters, calculations of the solenoids offset and tallying of the accounting had already occurred, as indicated by an absence of the first time flag, the program jumps from block 102 to block 106, as indicated to unmask the interrupt. At this time any updating of the display devices in the system is effected in block 107, and the format for the printer is set up in block 108 and printing effected, if it has been called for.

In accordance with one embodiment of the invention, as discussed above, the determination of the proportion between the different stampings, indicative of losing and various winning stampings, is effected by counts set in various counters. The initial settings may be effected, for example, during initialization of the system employing values stored in a programmable read only memory.

Figure 8:
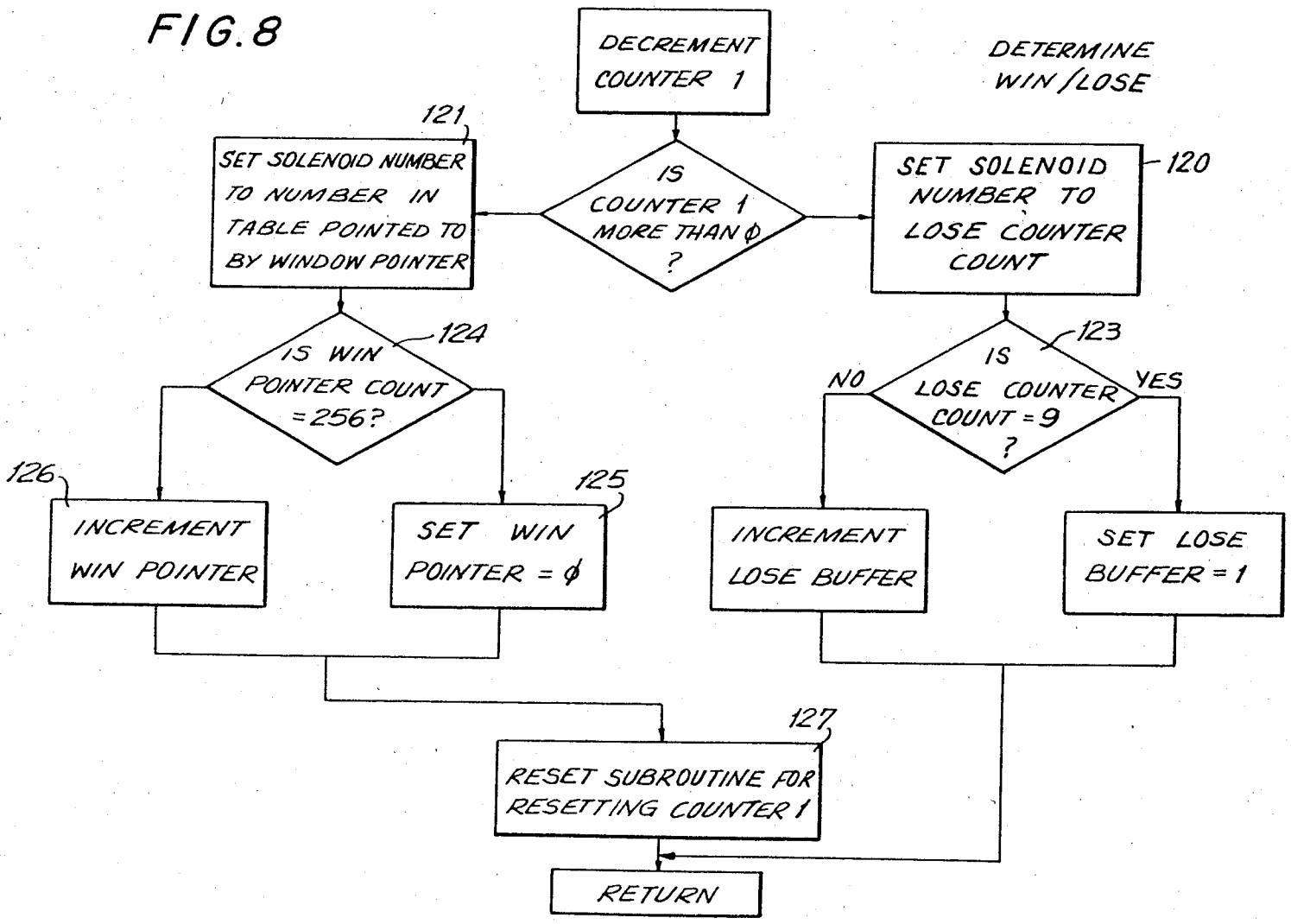
FIG. 8 is a flow diagram for determining the selection of solenoids to be energized.

In one example of a subroutine of this type, as illustrated in FIG. 8, upon jumping to the subprogram a first counter is decremented, and the resultant value thereof tested for zero. If the count is greater than zero, the solenoid 36 to be activated will not correspond to a winning solenoid 36, and the subroutine starting at block 120 is called. On the other hand, if the count in counter 1 is equal to zero, the subroutine for determining the winning solenoid, commencing at block 121, is called.

Assuming first that the first count had a count greater than zero, then, the solenoid to be actuated is determined in block 120 by the number stored in a lose counter. This, of course, assumes that a number of indicia, i.e., a number of solenoids, have stampings which are not considered "winning" stampings. Assuming, for example, that 9 of the solenoids are "losing" solenoids, in block 123 a test is made for the count of the lose counter, the count being reset to 1 if it is equal to 9 and incremented if it is less than 9, so that the buffer will provide the correct count for the next operation. This enables the continuous sequencing of these "lose" solenoids.

If on the other hand, a winning solenoid is to be selected, a solenoid is selected in block 121 as determined by the number stored in a table at a location pointed by a "win" pointer. If the win pointer equals 256, as tested in block 126, it is set to zero in block 125. Otherwise it is incremented in block 126. This enables the provision in ROM of a table with 256 listings of the "win" solenoid to be selected, the listings enabling the provision of any desired ratio between the stampings of each die. At this time since the "win" subroutine occurred with counter 1 equal to zero, this counter must be reset. If only a single row of dies is employed, in block 127 the counter 1 may be reset to any desired number, giving a predeterxined ratio between "winning" and losing solenoids. The subroutine then returns to the background routine of FIG. 7.

If the stamping system has two or more rows of dies, then the program step in block 127 may include subroutines for controlling the interrelationships between the stampings in each of the rows.

Figure 9:
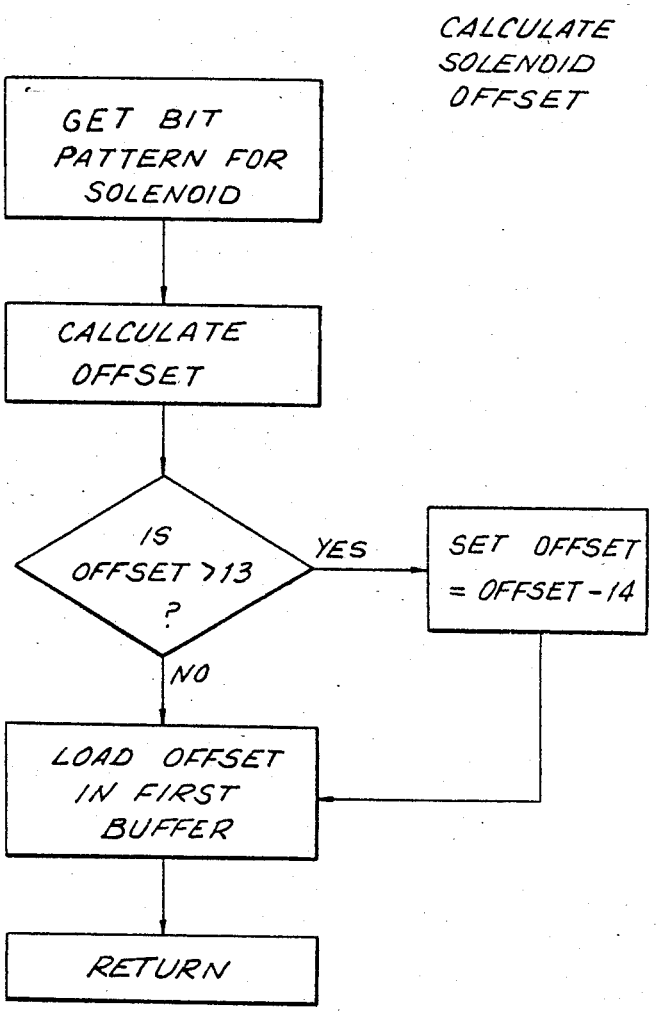
FIG. 9 is a flow diagram for calculating the offset of the solenoid to be energized.

In order to calculate the time at which a selected solenoid is to be energized, as illustrated in FIG. 9, the program first recovers the bit pattern for the solenoid. Then the program determines the offset of this bit pattern with respect to the beginning of the row. Upon testing for values greater than 13, i.e., the number of solenoids in a row, the offset for the firing of the solenoids is loaded in a fire buffer, so that upon the occurrence of an interrupt signal at the time corresponding to the calculated offset, the solenoid so selected will be fired or energized. It is of course apparent that, at any given interrupt more than one of the solenoids may be energized. For example, one of the "winning" solenoids may be aligned with the portion of the strip of metal to be stamped with that marking at the same time that one of the "losing" solenoids is aligned with a different portion of the strip that is to be marked with that losing indicia. Accordingly, at such time the solenoids would be energized to stamp the strip at the respective locations. The offset calculation subroutine then jumps the program back to the master program of FIG. 7.

At any time during the operation of the system, if the interrupt has been unmasked, the occurrence of an interrupt signal from the feed roll drive 111 indicating that the strip has stopped at one of its sequential locations, will cause the microcomputer program to jump to the main subroutine, as illustrated in FIG. 10. In this subroutine, if any of the solenoids has been selected for energization at this specific location of the strip, they will be energized in block 150. Following a delay and incrementing of the fire buffer, the program then jumps, in block 155, to the subroutine for determining the solenoid to be next energized such as illustrated in FIG. 8, followed by a jump in block 156 to the subroutine for calculating solenoid offset of FIG. 9. The subroutine of FIG. 10 then jumps to the further subroutines for updating the accounting in the system, followed by the return to the master program of FIG. 7. The specific point of return to the master program may be determined in the interrupt program, or it may return to the next stop which was to occur before the interrupt.

Since the relative number of stampings of each of the dies is controlled by software, it is apparent that the program may be readily changed merely by inserting a different programmable read only memory in the system. This change may of course be effected without any necessity for changing dies in the stamping system. The system has extreme security, as required in marketing programs of the type to which the invention is adapted, since an operator at the location of the system has no control whatsoever over the number of times each stamp is used, and a complete accounting of the system is maintained at all times. The removal of a programmable read only memory, for reading it out for purposes of fraud or replacement by an authorized program, may of course be detectable. In addition, the operator at any given location will not be provided with means for varying the program.

Since the marking system in accordance with the invention is controlled by programming of the microcomputer, the program may readily effect the storage of all desired parameters of operation of the system, in order to insure both the proper operation of stamping, and to enable the operator to determine that the desired ratio has occurred between the stamping of the various solenoids. For example, FIG. 11 shows one print-out of a "game" in which the total number of stampings is indicated as "end count", and a list is made of all the "winning" stamps, P, K, Y, X, Q and 25*c*. The print-out also identifies the particular program employed, as well as the number of resets and power failures that occur during operation.

The control panel may be provided with a control for effecting the print-out of the desired information, such as shown in FIG. 11, and the control panel may also include a control for effecting a "diagnostic" cycle, wherein the display is enabled to show various operated parameters within the system.

Since the stamping apparatus of the invention depends for depth of impression, primarily solely upon the amount of energy stored in the solenoid, the stamping depth is substantially independent of thickness of the material to be stamped, as well as independent of operating temperatures. Accordingly, it has been found, with equipment in accordance with the invention, no warmup time is required for the dies, thereby resulting in a saving of time as well as material. Further, the lack of mechanical stops reduces the wear on the stamping equipment, thereby increasing its life.

It has further been found that even wear of the raised portion of the dies does not require the replacement to the extent required in previous stamping systems employing stops. Thus, in a stamping operation employing stops, the wearing of a die will result in a lower depth of penetration of the marking. In the arrangement of the present invention, however, the wearing of the markings merely tends to broaden the impression, and since the die is always projected at the material with the same energy, in some cases a certain amount of wear will actually improve the readability of the marking. It has further been found that the initial settings for the positioning of the dies is not especially critical in the arrangement of the invention, and constant readjustment of the mechanical components of the system is not required.

As a still further advantage, even if the various parameters of the stamping operation are changed, they may be readily compensated by adjustments in the software rather than requiring mechanical adjustment. Thus, if a change occurs in the material to be stamped, such as an increase or decrease in hardness, the program can be easily changed to vary the width of the pulses applied to the solenoid driving circuits to maintain constant depth stampings.

While the invention has been disclosed and described only with respect to the marking of tabs of aluminum ends, in such sequences and proportions that the indicia on the tabs may be employed in the promotion of the sale of beverages in the cans, it is apparent that the invention is also adaptable to other uses. Thus, the system may be employed for stamping other materials, such as plastics, and need not be employed, within the broad aspects of the invention, in promotional or "winning and losing" programs. It is therefore intended in the following claims to cover each such variation and modification as falls within the true spirit and scope of the invention.

What is claimed is:

1. A method for stamping indicia on thin sheet material comprising feeding said material into spaced alignment with a die, applying energy to said die to rapidly impart a determined kinetic energy thereto to direct it at high velocity toward said material by energizing a solenoid having an armature positioned to impart energy to said die, said step of energizing comprising energizing said solenoid with a duty cycle of less than 2 percent and a high power dissipation from 10 to 20 times the continuous rating thereof, said high power dissipation rapidly imparting said high velocity to said die, guiding said die to impact said material to dissipate substantially all of the kinetic energy imparted thereto in said step of applying in the deformation of said material while maintaining the relative alignment of said material and die, and resiliently retracting said die from said material after said impact.

2. The method of claim 1 wherein said step of feeding comprises stopping said material in alignment with said die prior to said step of applying energy to said die, and maintaining said stop position of said die until said die has been retracted from said material.

3. The method of claim 1 wherein said step of retracting comprises retracting said die substantially perpendicularly from said material.

* * * * *